US010315842B2

(12) United States Patent
Seader et al.

(10) Patent No.: US 10,315,842 B2
(45) Date of Patent: Jun. 11, 2019

(54) SYSTEM FOR SECURING A LID OF A CONTAINER TO PREVENT ANIMAL INTRUSION

(71) Applicant: Western Disposal, Inc., Boulder, CO (US)

(72) Inventors: Mike G. Seader, Longmont, CO (US); William A. May, Longmont, CO (US); Stanley L. Schisler, Berthoud, CO (US)

(73) Assignee: Western Disposal, Inc., Boulder, CO (US)

( * ) Notice: Subject to any disclaimer, the term of this patent is extended or adjusted under 35 U.S.C. 154(b) by 797 days.

(21) Appl. No.: 14/744,551

(22) Filed: Jun. 19, 2015

(65) Prior Publication Data

US 2015/0368042 A1 Dec. 24, 2015

Related U.S. Application Data

(60) Provisional application No. 62/014,992, filed on Jun. 20, 2014.

(51) Int. Cl.
*E05C 1/00* (2006.01)
*B65F 1/16* (2006.01)

(52) U.S. Cl.
CPC ..... *B65F 1/1615* (2013.01)

(58) Field of Classification Search
CPC ..... Y10T 292/0825; Y10T 292/0911; Y10T 292/1006; Y10T 292/1047; Y10S 220/908; E05C 3/30; E05C 19/10; E05C 3/34

See application file for complete search history.

(56) References Cited

U.S. PATENT DOCUMENTS

| | | | | | |
|---|---|---|---|---|---|
| 3,831,580 | A * | 8/1974 | McLean | E05C 5/00 | 126/197 |
| 4,178,025 | A * | 12/1979 | Robins | E05C 3/14 | 292/117 |
| 4,451,072 | A * | 5/1984 | Petty, Sr. | E05C 3/14 | 292/104 |
| 4,871,203 | A * | 10/1989 | Rogers | E05C 3/14 | 292/238 |
| 5,012,794 | A * | 5/1991 | Faurel | E05C 5/00 | 126/191 |
| 7,549,552 | B2 * | 6/2009 | Hasegawa | H01L 21/67373 | 206/710 |
| 7,681,752 | B2 | 3/2010 | Moore | | |
| 7,775,564 | B2 | 8/2010 | Moore | | |
| 8,479,944 | B2 | 7/2013 | Moore | | |
| 2007/0084865 | A1 * | 4/2007 | Moore | B65F 1/1615 | 220/326 |

* cited by examiner

*Primary Examiner* — Mark A Williams
(74) *Attorney, Agent, or Firm* — Lathrop Gage LLP

(57) ABSTRACT

A system is provided for securing a lid of a container to prevent animal intrusion that includes a container, a lid, and a mechanism for securing the lid in a closed position. In an embodiment, the mechanism includes a gravity-actuated swivel lock for locking the mechanism when the container is tilted from a preferred orientation. In another embodiment, the system includes a mechanical claw configured to press at least one release lever for releasing the container lid, while grasping the container for lifting and tilting, to empty the container contents into a garbage truck.

21 Claims, 18 Drawing Sheets

SYSTEM FOR SECURING A LID OF A CONTAINER TO PREVENT ANIMAL INTRUSION

RELATED APPLICATIONS

This application claims priority to U.S. Provisional Application Ser. No. 62/014,992, entitled "SYSTEM FOR SECURING A LID OF A CONTAINER AGAINST ANIMAL INTRUSION", and filed Jun. 20, 2014. The aforementioned application is incorporated by reference in its entirety.

BACKGROUND

The invention relates to portable waste containers for use outdoors. Portable waste containers may be used for temporary storage of garbage, recyclable materials, or other items until the containers are emptied and the contents are transported to a centralized location. Preventing animal intrusion into the containers is important for both animal and human safety. Prior art containers do not provide portable systems that prevent animal intrusion while being operable by both humans and mechanical means.

SUMMARY

In an embodiment, a system for securing a lid of a container to prevent animal intrusion is provided. The system includes a first notched arm including a first notch, the first notched arm coupled to the container about a first pivot, a first catch coupled to the lid at a location corresponding to the first notched arm and configured to hook the notch to maintain the lid in a closed position, and a first release lever coupled to the first notched arm and protruding outside the container for releasing the first notched arm from the first catch such that the lid may move to an opened position.

In another embodiment, a system for securing a lid of a container to prevent animal intrusion is provided. The system includes a first notched arm and a second notched arm, each mechanically coupled to the container about a first pivot and a second pivot, respectively. The system further includes a first catch and a second catch, each fixed to the lid at a location corresponding to the first and second notched arms, respectively, and configured to hook the notch of the respective notched arm, thereby securing the lid in the closed position. Finally, the system includes a first release lever and a second release lever, each mechanically coupled to first notched arm and second notched arm, respectively, wherein first and second release levers protrude outside the container and are configured to release the lid when pressed.

In yet another embodiment, a system for unsecuring a lid of a container to prevent animal intrusion is provided. The system includes a mechanism for securing the lid in a closed position, and a first and second release lever each mechanically coupled to the mechanism and protruding outside the container and configured to release the container lid when pressed. The system further includes a mechanical claw configured to grasp the container for lifting and tilting to empty the container contents into a garbage truck, wherein the mechanical claw is configured to press the first and second release levers to unsecure the container lid upon grasping the container.

DETAILED DESCRIPTION OF THE EMBODIMENTS

Containers that are used to store waste outdoors may be temporarily located along a curbside or street for pickup. At other times, the container may be stored away from the street requiring it to be easily portable. While outdoors, the container may require features to prevent animal intrusion. Embodiments of the system described herein include one or more of a container, a lid, and a lid-locking device that are sturdy enough to prevent animal intrusion while being lightweight enough to remain easily portable. Embodiments of the present disclosure require a human user to perform two operations simultaneously to open the container lid, one with each hand, making it unlikely for an animal to perform. The lid-locking device is designed to automatically lock upon closing of the lid, to not be operable by animals, and to not unlock upon tipping over or tilting of the container.

Embodiments of the present disclosure include a lid-locking device that may be operated by both humans and mechanical means. A mechanical claw described herein is designed specifically to grasp and lift the container without crushing the container and to automatically unlock the lid upon grasping the container. Two levers are simultaneously depressed by the mechanical claw on opposite sides of the container making it unlikely to be performed by an animal.

This enables a garbage truck equipped with the mechanical claw to automatically unlock the container lid while lifting and tilting the container, allowing the lid to swing open due to gravity, and emptying the container contents into the garbage truck.

Figure 1:
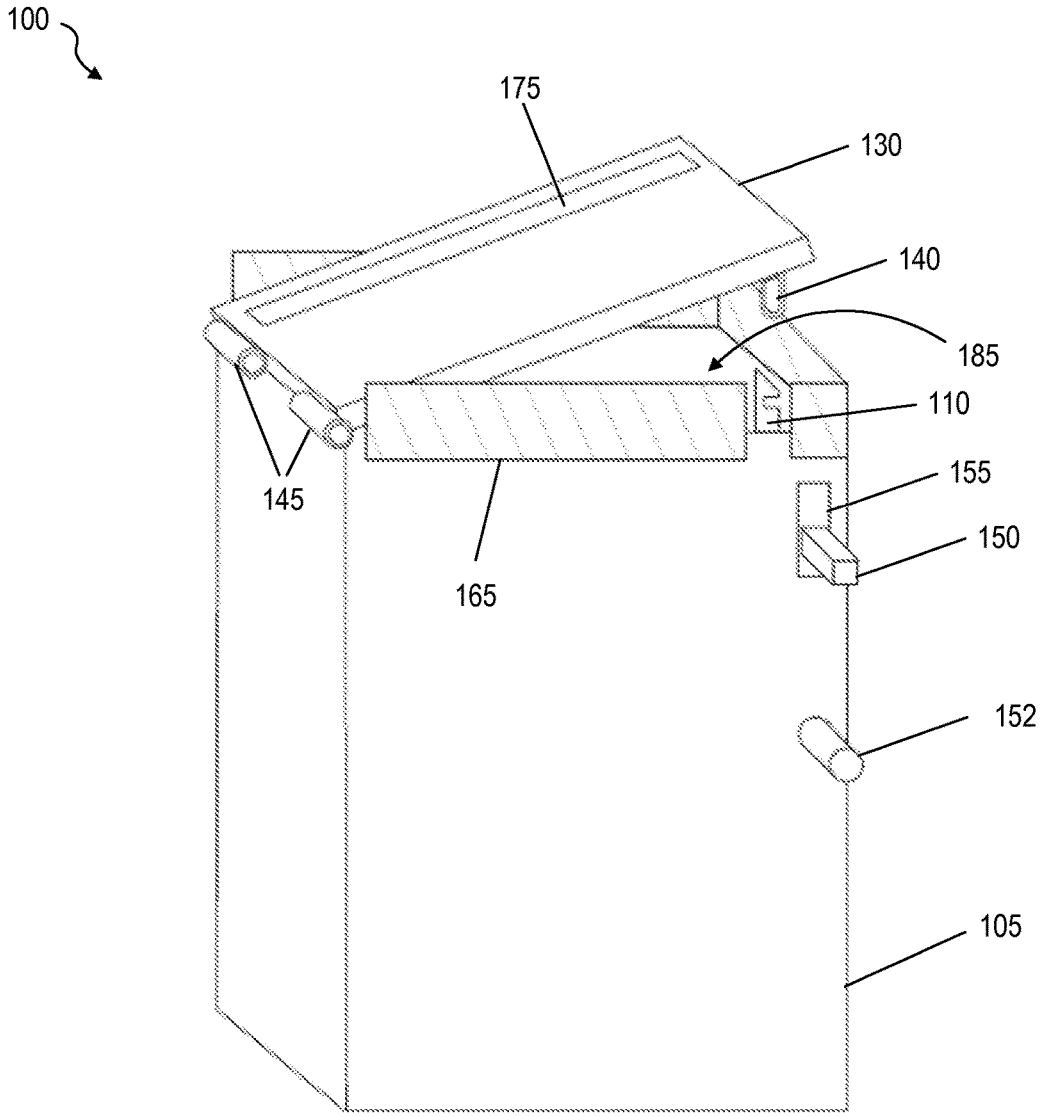
FIG. 1 shows one embodiment of a system for securing a lid of a container to prevent animal intrusion.

FIG. 1 shows a system 100 for securing a lid of a container to prevent animal intrusion. System 100 includes a container 105 oriented in a preferred (upright) orientation with a lid 130 on top. Lid 130 covers an opening 185 of container 105. Container 105 includes at least one hinge 145 that joins lid 130 and container 105, allowing lid 130 to pivot between an open position and a closed position. In an embodiment, hinge 145 is protected from damage by a supporting material, such as plastic or metal, which is not shown in FIG. 1 for clarity of illustration. The supporting material prevents an animal from prying open the lid at the hinges. Lid 130 includes a catch 140 fixed thereto, and container 105 includes a notched arm 110 mounted inside container 105. When lid 130 is closed, notched arm 110 hooks catch 140 thereby securing lid 130 in the closed position. System 100 further includes a guard that protects notched arm (see FIG. 2). The guard is not shown in FIG. 1 for clarity of illustration to enable viewing of notched arm 110.

A first release lever 150 protrudes outside container 105 through a gap 155. First release lever 150 is mechanically coupled to notched arm 110 (see, for example FIGS. 6, 8, and 9). Pressing first release lever 150 causes notched arm 110 to release from catch 140, thereby releasing lid 130 for opening. A flange 165 mounts along a rim of container 105 surrounding an opening 185. Flange 165 prevents access to an interface between lid 130 and container 105 when lid 130 is in the closed position. Flange 165 is partially shown in FIG. 1 for clarity of illustration to enable viewing of other components, but flange 165 may be configured to completely overlap the opening between container 105 and lid 130. Supports made from metal strips or bars, such as a support 175, may be mounted on lid 130 or container 105 to provide additional strength. Additional supports may be mounted to lid 130 and container 105 without departing from the scope hereof. System 100 may include a second release lever 152. Second release lever connects to notched arm 110 (see FIGS. 6, 8, and 9).

Figure 2:
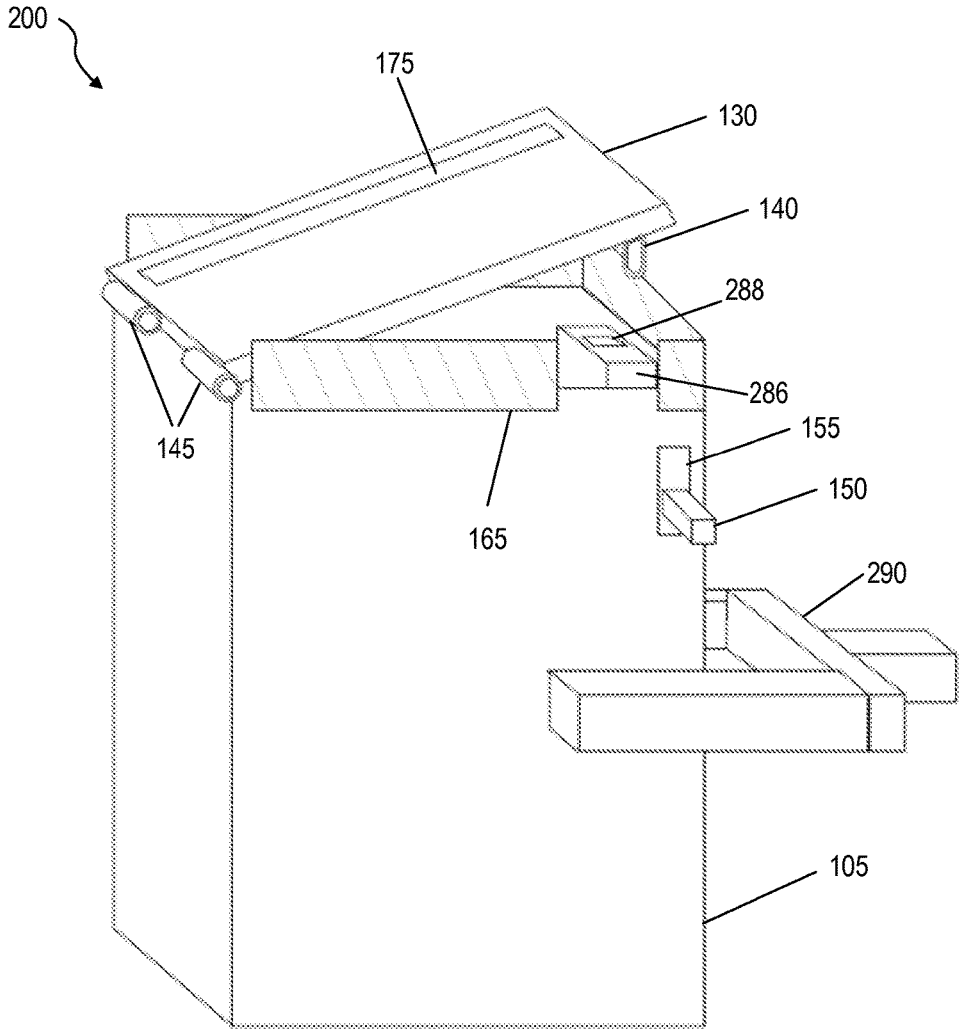
FIG. 2 shows the system of FIG. 1 and a mechanical claw, in an embodiment.

FIG. 2 shows a system 200 for securing a lid of a container to prevent animal intrusion. FIG. 2 includes system 100 of FIG. 1 and a mechanical claw 290 and is best viewed together with FIG. 1 and the following description. Container 105 is configured to be grasped by mechanical claw 290 in a location that overlaps second release lever 152 (see FIG. 1). Second release lever is configured to be pressed inward by mechanical claw 290 to release lid 130 for opening.

Figure 15:
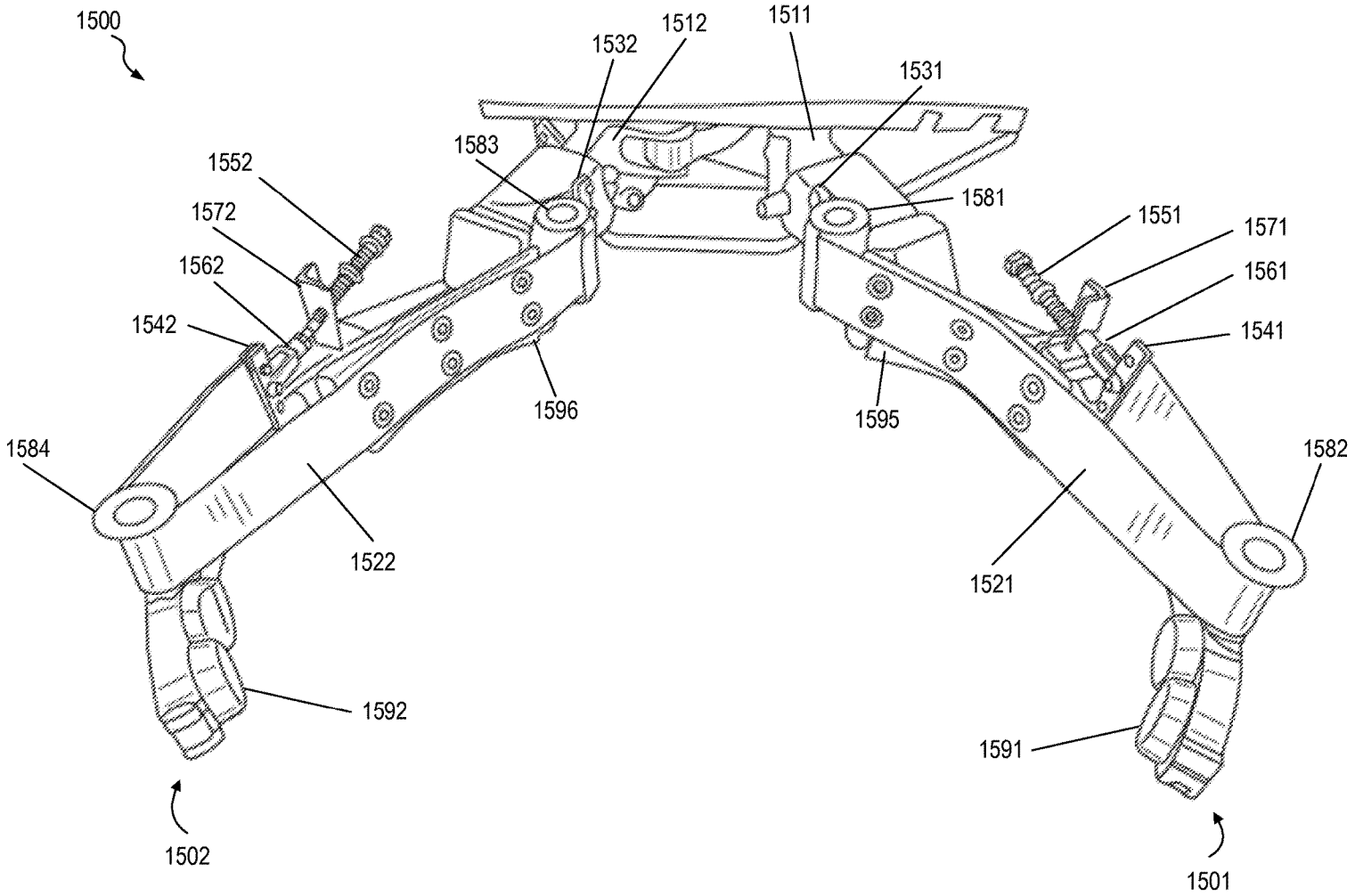
FIG. 15 depicts a mechanical claw for automatically releasing a lid of a container while grasping the container.
Figure 16:
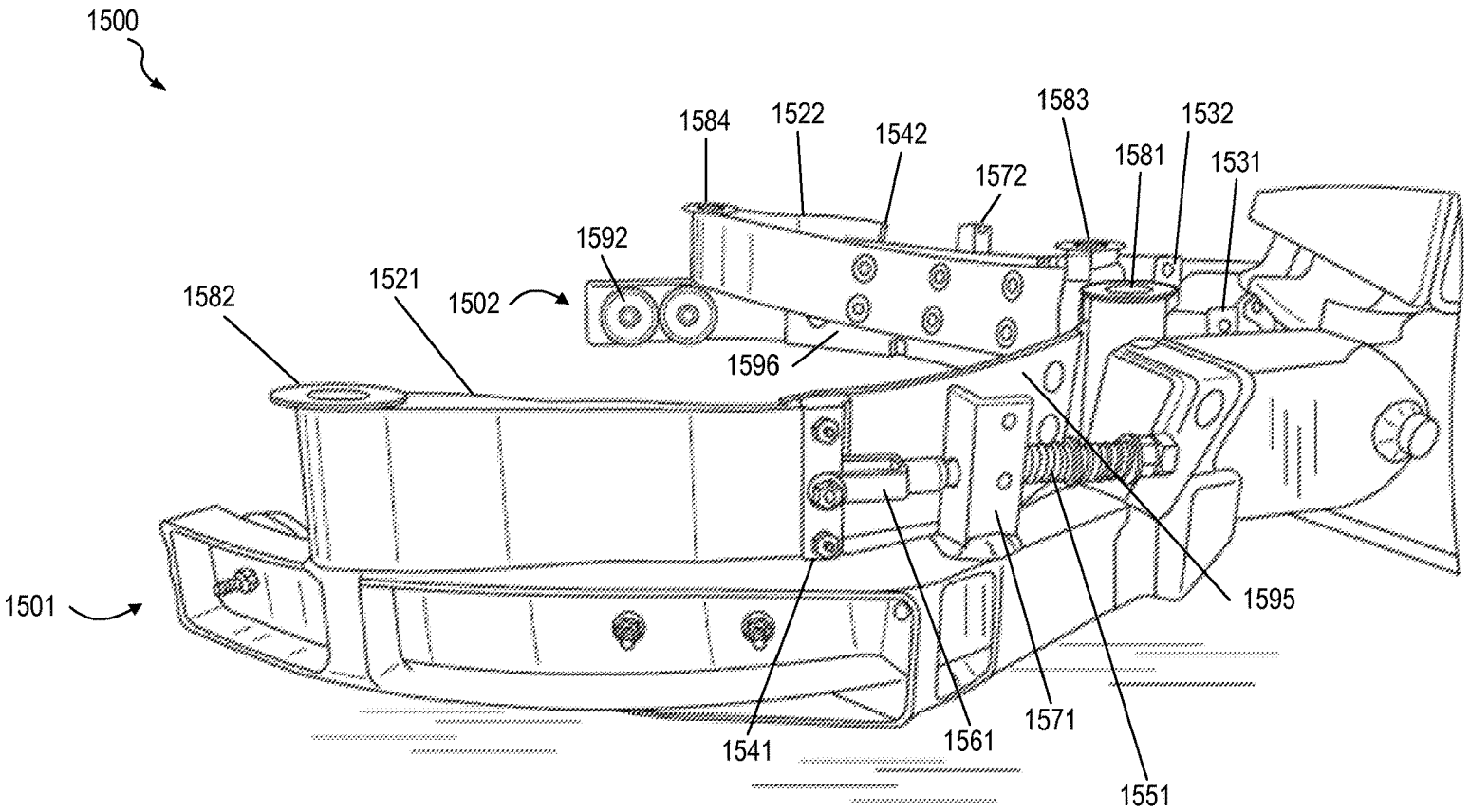
FIG. 16 depicts the mechanical claw of FIG. 15 from a side perspective.

Mechanical claw 290 may attach to a garbage truck for the purpose of lifting and tilting container 105 to dump the contents into the garbage truck. FIGS. 15 and 16 show a mechanical claw in exemplary detail. Second release lever 152 is configured to be automatically pressed when mechanical claw 290 grasps container 105, thereby releasing lid 130 to swing open due to gravity when container 105 is tilted upside down. After returning container 105 to the ground, mechanical claw 290 releases container 105 and second release lever 152 so that lid 130 may be secured closed.

System 200 further includes a guard 286 that protects notched arm 110, and all mechanisms coupled to notched arm 110, from obstruction or damage due to contact with contents inside container 105. Guard 286 includes a first port 288 to permit entry of catch 140. Guard 286 may include a tapered end, opposite first port 288, shaped to prevent contents of container 105 from getting caught beneath guard 286 when container 105 is tilted for emptying. A second port (not shown) is located on a side of guard 286 for first release lever 150 to extend outside container 105. Likewise, a third port (not shown) is located on a side of guard 286 for second release lever 152 to extend outside container 105. Guard 286 and the lid-locking mechanism protected inside guard 286, including notched arm 110, may be located on the outside of container 105 without departing from the scope hereof (see, for example, FIG. 17).

Figure 3:
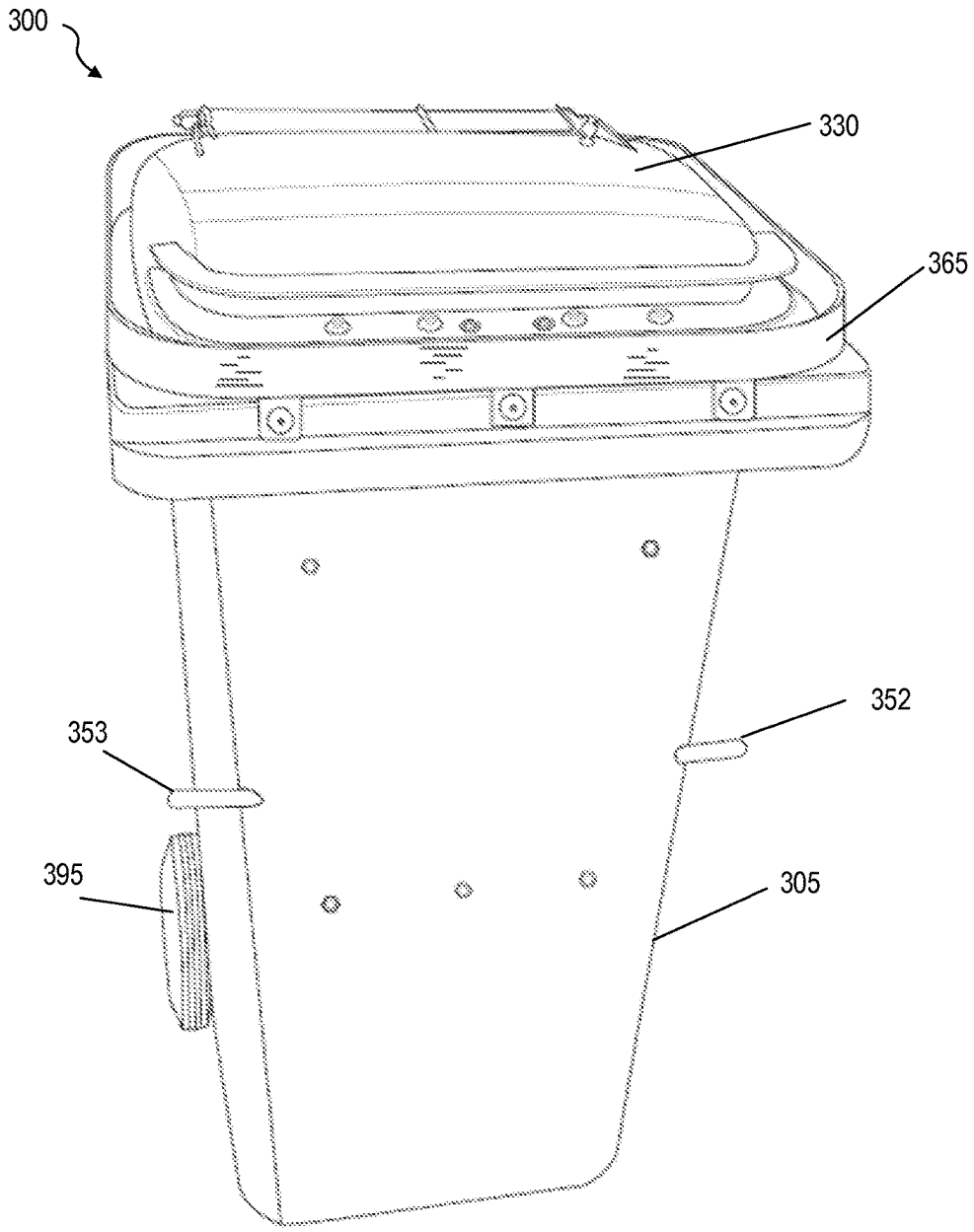
FIG. 3 shows one embodiment of a system for securing a lid of a container to prevent animal intrusion.

FIG. 3 shows a system 300 for securing a lid of a container to prevent animal intrusion, which is similar to system 100 of FIG. 1. System 300 includes container 305, lid 330, flange 365 and second release lever 352, which are similar to container 105, lid 130, flange 165, and second release lever 152 of FIG. 1, respectively. A first release lever may be located on a side of container 305 and beneath lid 330 such that the lever is not in view in FIG. 3. System 300 also includes a third release lever 353, located opposite second release lever 352. The purpose of third release lever 353 is to pivot a second notched arm (see, for example, FIGS. 12 and 18). Second and third release levers 352, 353 are configured to be simultaneously pressed by mechanical means, such as mechanical claw 290 of FIG. 2 or mechanical claw 1500 of FIGS. 15 and 16, to rotate one or more notched arms for releasing lid 330.

System 300 further includes a first wheel, such as first wheel 395, and a second wheel, which is not in view in FIG. 3. First wheel 395 and second wheel provide portability to system 300. Weight-saving features of system 300 include parts made from thinner material, a narrower profile guard, and cutaway sections. An example of a catch plate with cutaway material for a lightweight design is shown in FIG. 4.

Figure 4:
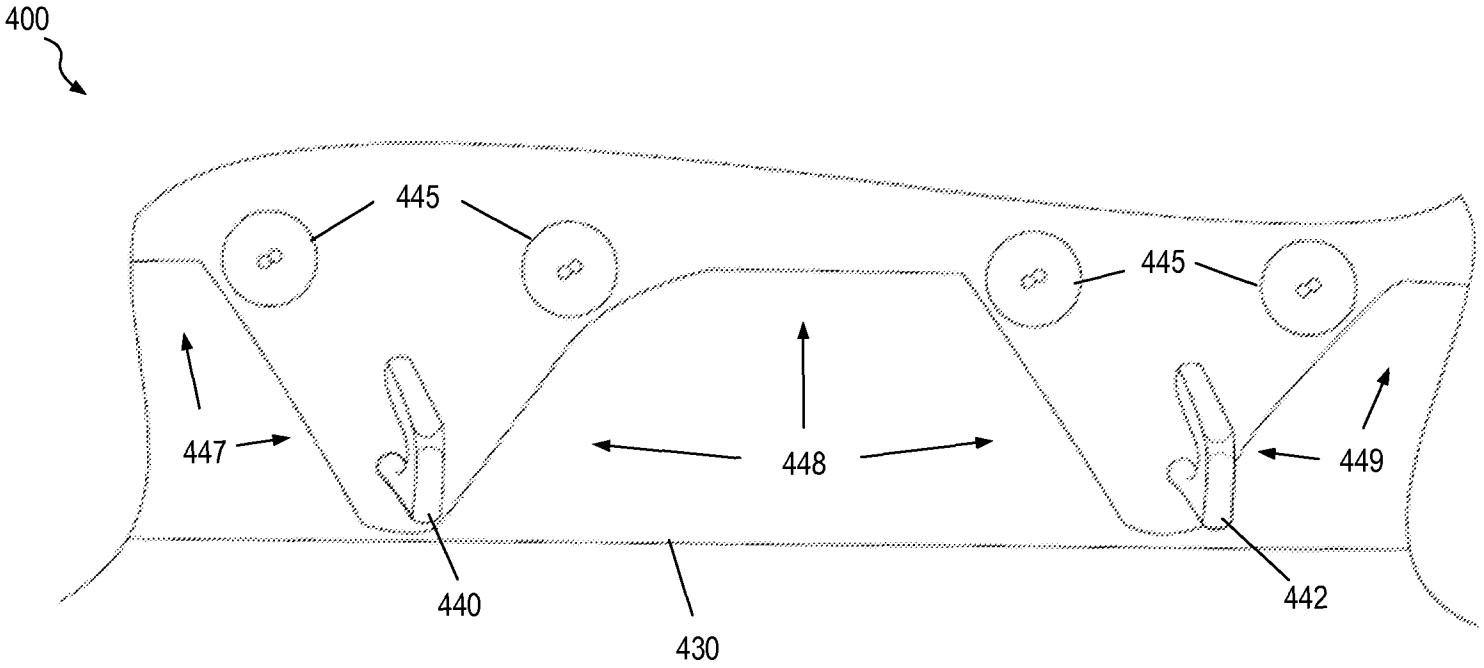
FIG. 4 shows one embodiment of a catch plate from a system for securing a lid of a container to prevent animal intrusion.

FIG. 4 shows an exemplary catch plate 400 for securing a lid of a container to prevent animal intrusion. Catch plate 400 includes a first catch 440 and a second catch 442. First and second catch 440, 442, which are examples of catch 140 of FIG. 1, are intended to catch two notched arms (see, for example, FIGS. 12 and 18). Catch plate 400 is fixed to the underside of a lid 430, which is an example of lid 130 of FIG. 1. Catch plate 400 is fixed to lid 430 by bolts or rivets for example. FIG. 4 shows four exemplary rivets 445 used to fix catch plate 400 to lid 430. Note the shape of catch plate 400, which includes a first cutaway section 447, a second cutaway section 448 located between first catch 440 and second catch 442, and a third cutaway section 449. The cutaway sections 447, 448, 449 are shaped to reduce weight of catch plate 400.

Figure 5:
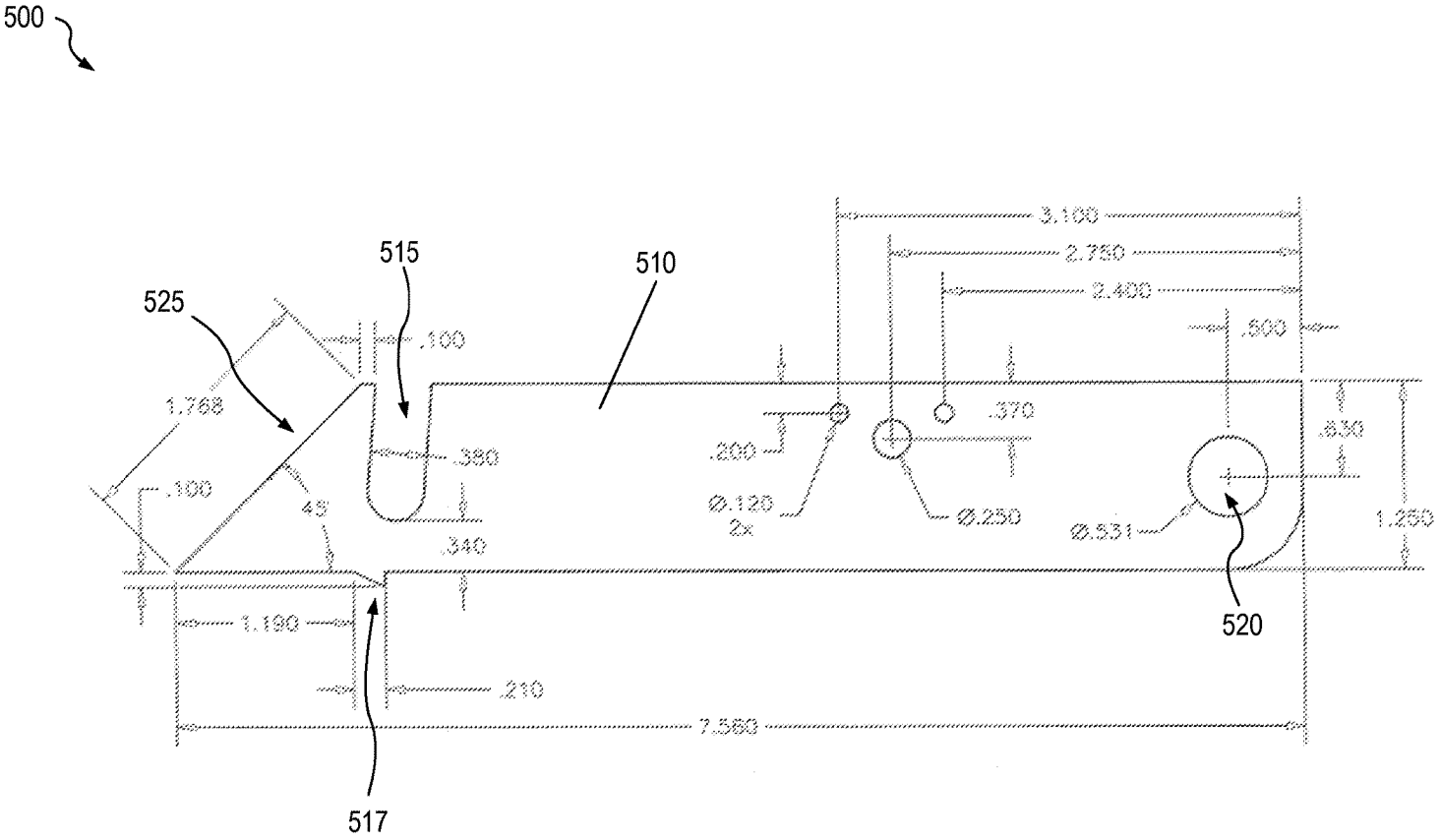
FIG. 5 shows one embodiment of a notched arm from a system for securing a lid of a container to prevent animal intrusion.

FIG. 5 shows an exemplary notched arm 601 from a system for securing a lid of a container to prevent animal intrusion, such as system 100 of FIG. 1 or system 300 of FIG. 3, for example. Notched arm 500 includes an arm 510 with a notch 515, a protrusion 517, and an angled end 525. A pivot hole 520 provides a hole for a pivot that may be formed by a rod, pin, dowel, or bolt, for example for pivoting notched arm 500. FIG. 5 includes exemplary dimensions in inches for one embodiment of notched arm 500. For example, arm 510 is 1.250 inches wide and 7.560 inches long, notch 515 is 0.380 inch wide, and angled end 525 has a forty-five degree angle with respect to a long edge of arm 510. Arm 510 is, for example, made from material, such as steel or aluminum, which is 0.105 inch thick. However, it should be appreciated that arm 510 may be made from alternate materials with sufficient strength, such as plastic, wood, composites, etc. Pivot hole 520 passes through notched arm 500 and is 0.531 inch in diameter, for example. Specific dimensions of notched arm 500 may vary from those shown in FIG. 5 without departing from the scope hereof.

Figure 6:
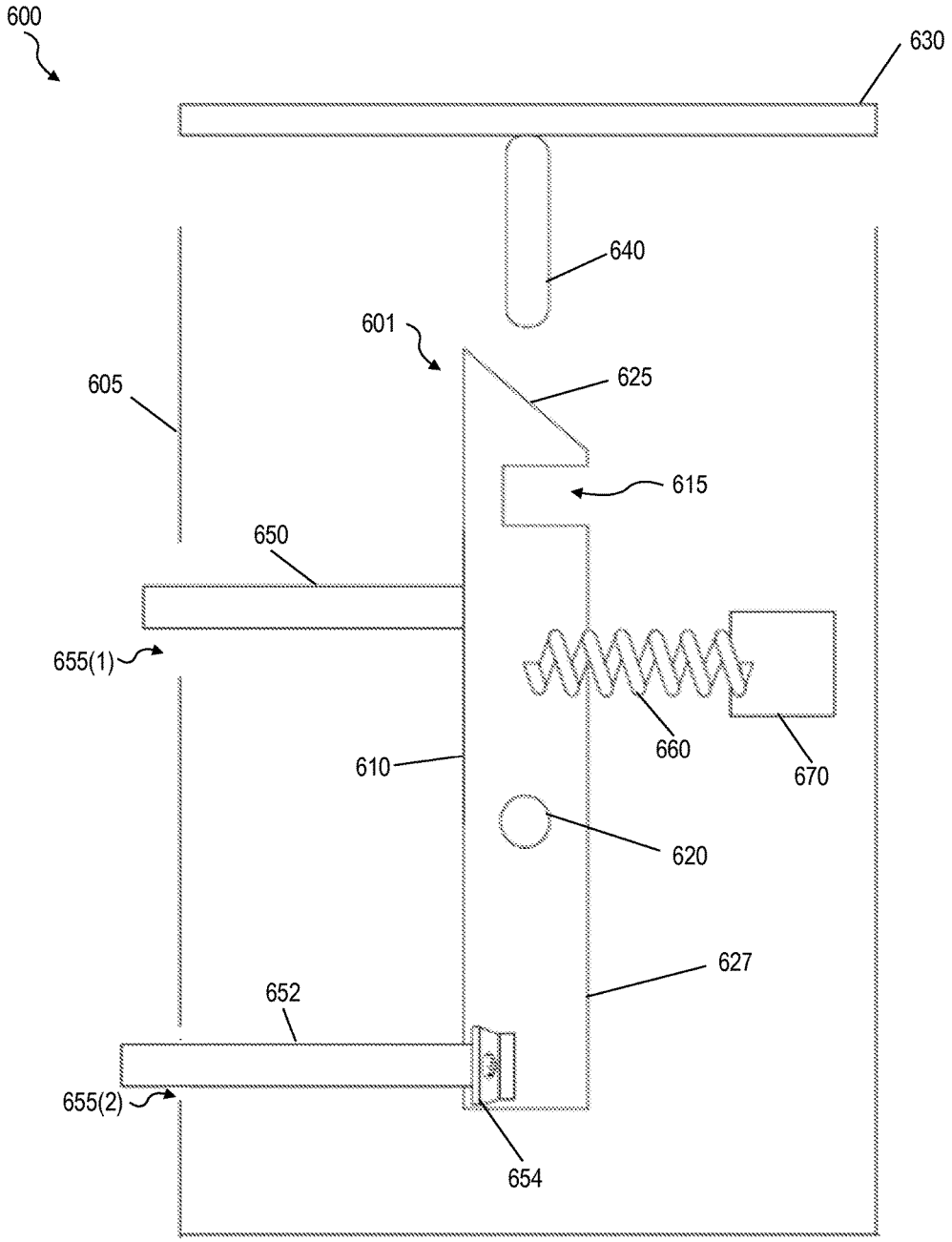
FIG. 6 shows one embodiment of a mechanism for securing a lid of a container to prevent animal intrusion with the lid in an open position.

FIG. 6 shows a schematic drawing of an exemplary mechanism 600 for securing a lid of a container to prevent animal intrusion. Mechanism 600 includes a container 605 and a lid 630 in an open position. FIGS. 6-9 illustrate lid 630 from different perspectives or in different positions, and are best viewed together with the following description. Fixed to lid 630 is a catch 640, which is an example of catch 140 of FIG. 1. Catch 640 may be a bar, hook, eyelet, or any other configuration capable of interconnecting with notch 615 of notched arm 601 for securing lid 630 in the closed position. One embodiment of catch 640 is an eyelet (see FIG. 7).

Figure 7:
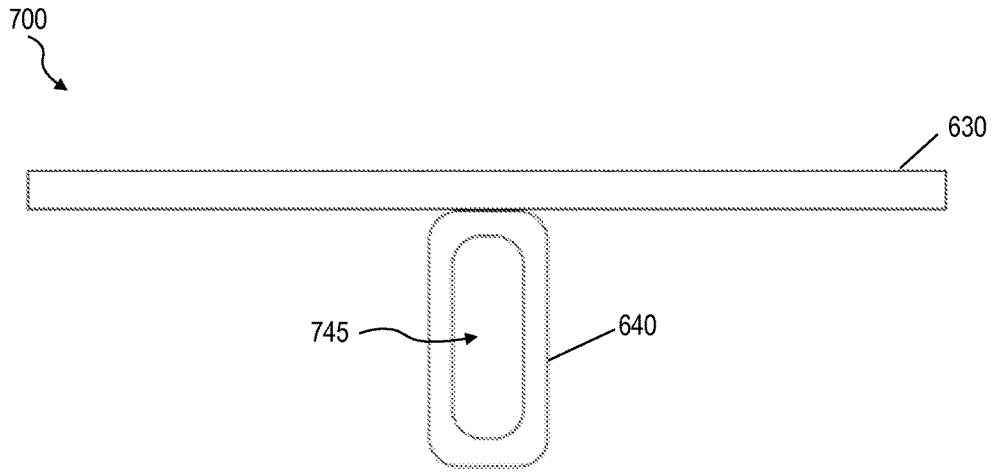
FIG. 7 shows a side view of the lid of FIG. 6, in an embodiment.

FIG. 7 is a side view 700 of lid 630 and catch 640, orthogonal to the view of FIG. 6, which shows an opening 745 that passes through catch 640.

Referring again to FIG. 6, notched arm 601 includes an upper portion 610 above pivot 620 and a lower portion 627 below pivot 620. Lower portion 627 may be fixed to upper portion 610 by bolts, rivets, or welding for example. A first release lever 650, which is mechanically coupled to upper portion 610 of notched arm 601, protrudes outside container 605 through a first gap 655(1). First gap 655(1) is appropriately sized to enable motion of first release lever 650 while preventing animal access inside container 605. In an embodiment, upper portion 610, lower portion 627 and release lever 650 may be made from a single piece of material, such as a machined piece of aluminum.

Lower portion 627 is configured to mechanically couple with a second release lever 652 for rotating notched arm 601 about pivot 620. Second release lever 652 is an example of second release lever 152 of FIG. 1 intended for pressing by mechanical means, such as mechanical claw 290 of FIG. 2 or mechanical claw 1500 of FIGS. 15 and 16. Note that mechanical coupling between notched arm 601 and first and second release levers 650, 652 may be created by weld, by bolts secured with nuts, by brackets, by one or more screws threaded through tapped holes, or by one or more rivets, or any similar device, without departing from the scope thereof. FIG. 6 shows a bracket 654 as one embodiment of mechanical coupling between second release lever 652 and notched arm 601. Second release lever 652 protrudes outside container 605 through a second gap 655(2).

Affixed to notched arm 601 is a spring 660. Spring 660 may be an extension spring, as is depicted in FIG. 6. However, the drawing is not intended to limit the scope of the spring, but merely to illustrate one potential type of spring. Other types of appropriate springs include leaf springs, compression springs, and torsional springs. A stay 670 is shown attached to one end of spring 660. Stay 670 may be a fixed rigid body or a rigid body with one or more degrees of freedom (see, for example, stay 1070 of FIG. 10). Stay 670 may be positioned next to the notched arm 601 as depicted in FIG. 6, or it may be located in a different position in order to provide an effective spring system, depending on the type of spring and other design considerations. In an embodiment, spring 660 is an extension spring that acts to pull notched arm 601 into the lid-securing orientation, as depicted in FIG. 6.

Figure 8:
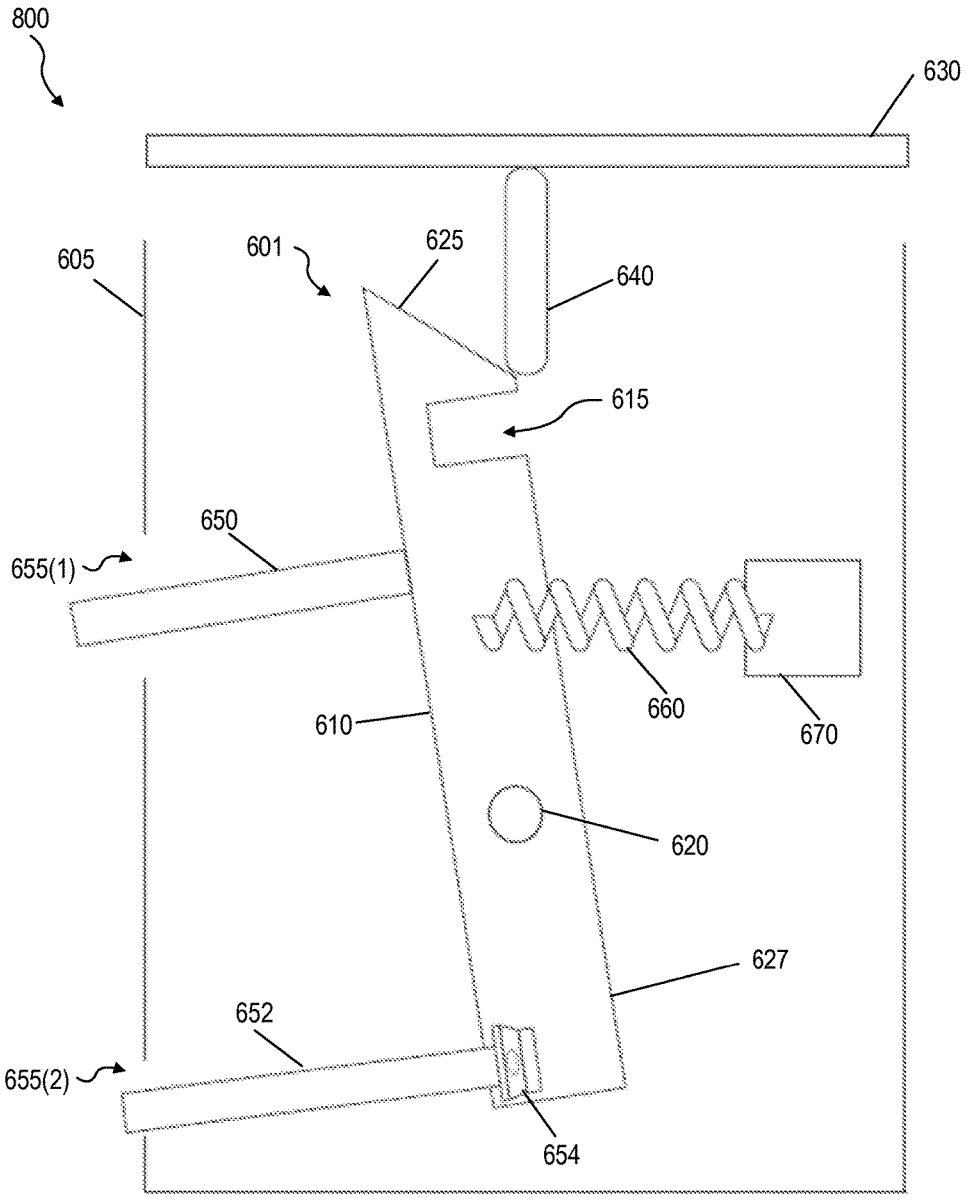
FIG. 8 shows the mechanism of FIG. 6 with the lid in a partially closed position.

FIG. 8 shows mechanism 800, which is an example of mechanism 600 of FIG. 6 with lid 630 in a partially closed position. In the partially closed position, catch 640 is aligned to contact notched arm 601 along angled end 625. The force of catch 640, from the weight of lid 630, applied to angled end 625, causes notched arm 601 to rotate about pivot 620. Spring 660 counteracts rotation of notched arm 601 but is configured appropriately to enable rotation of notched arm 601 due to the weight of lid 630. As lid 630 is further closed, catch 640 moves past angled end 625 to notch 615. The force of spring 660 counter rotates notched arm 601 to the lid-securing orientation, causing catch 640 to hook with notch 615.

Figure 9:
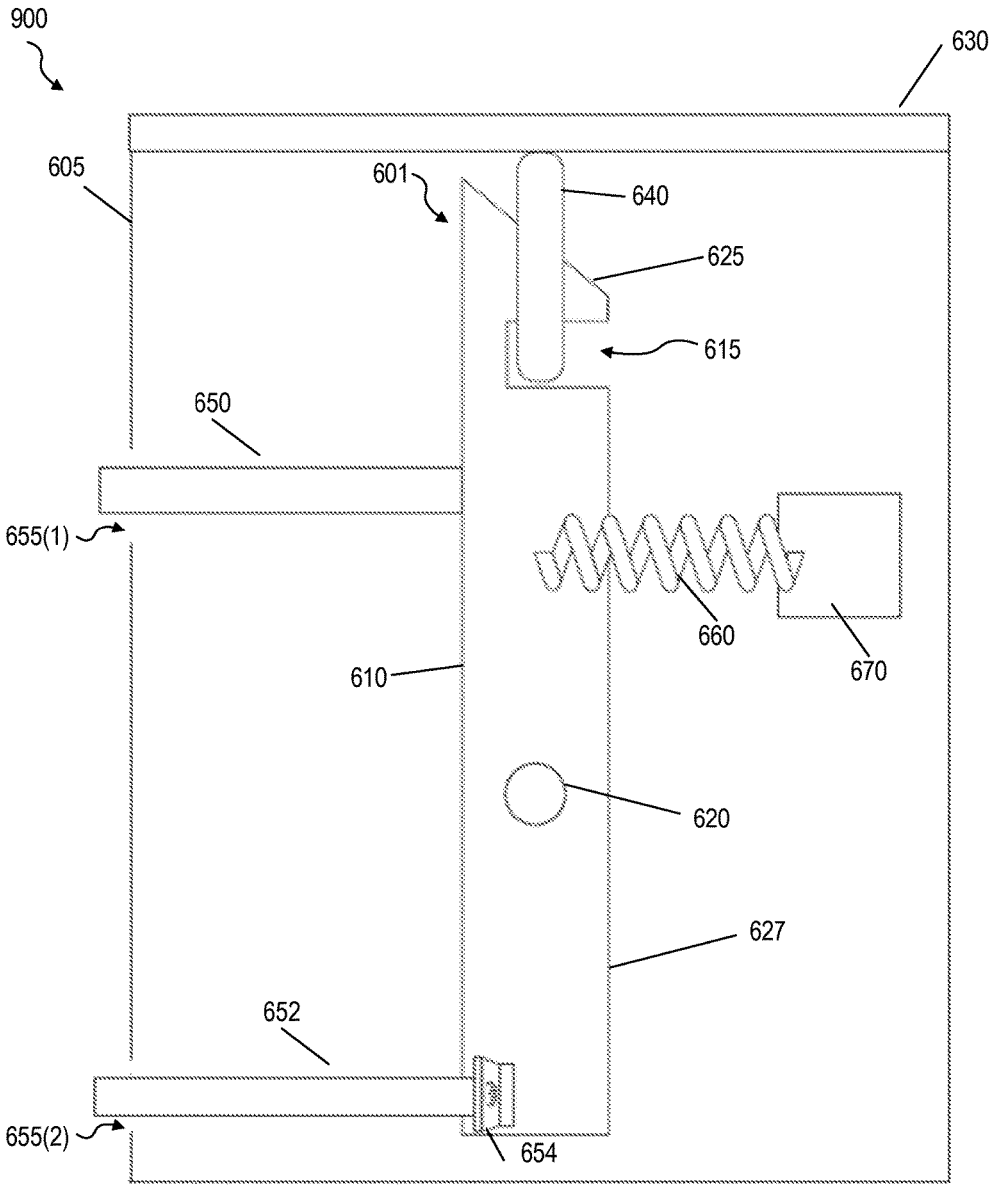
FIG. 9 shows the mechanism of FIG. 6 with the lid in a fully closed position.

FIG. 9 shows mechanism 900, which is an example of mechanism 600 of FIG. 6 with lid 630 in a fully closed position. Here, catch 640 includes an eyelet with an opening (see FIG. 7), which is hooked to notch 615 of notched arm 601. Notched arm 601 is in the lid-securing orientation, thereby maintaining lid 630 in the closed position. A human user may unlock and open lid 630 by pressing first release lever 650 down with one hand, to rotate notched arm 601 and free catch 640, while simultaneously lifting lid 630 with the other hand. Alternatively, a mechanical means, such as mechanical claw 290 of FIG. 2 or mechanical claw 1500 of FIGS. 15 and 16, presses second release lever 652 while grasping container 605 to rotate notched arm 601 and free catch 640 to release lid 630. Second release lever 652 is configured to be pressed inward, for example.

Mechanisms 600, 800 and 900 of FIGS. 6, 8 and 9, respectively, may include a guard, such as guard 286 of FIG. 1 for example, to protect the lid-locking mechanism, including notched arm 601, from obstruction or damage due to contact with contents inside container 605. In an embodiment, guard 286 is located outside container 605 to protect the lid-locking mechanism mounted on an outside surface of container 605 (see, for example, FIG. 17).

Figure 10:
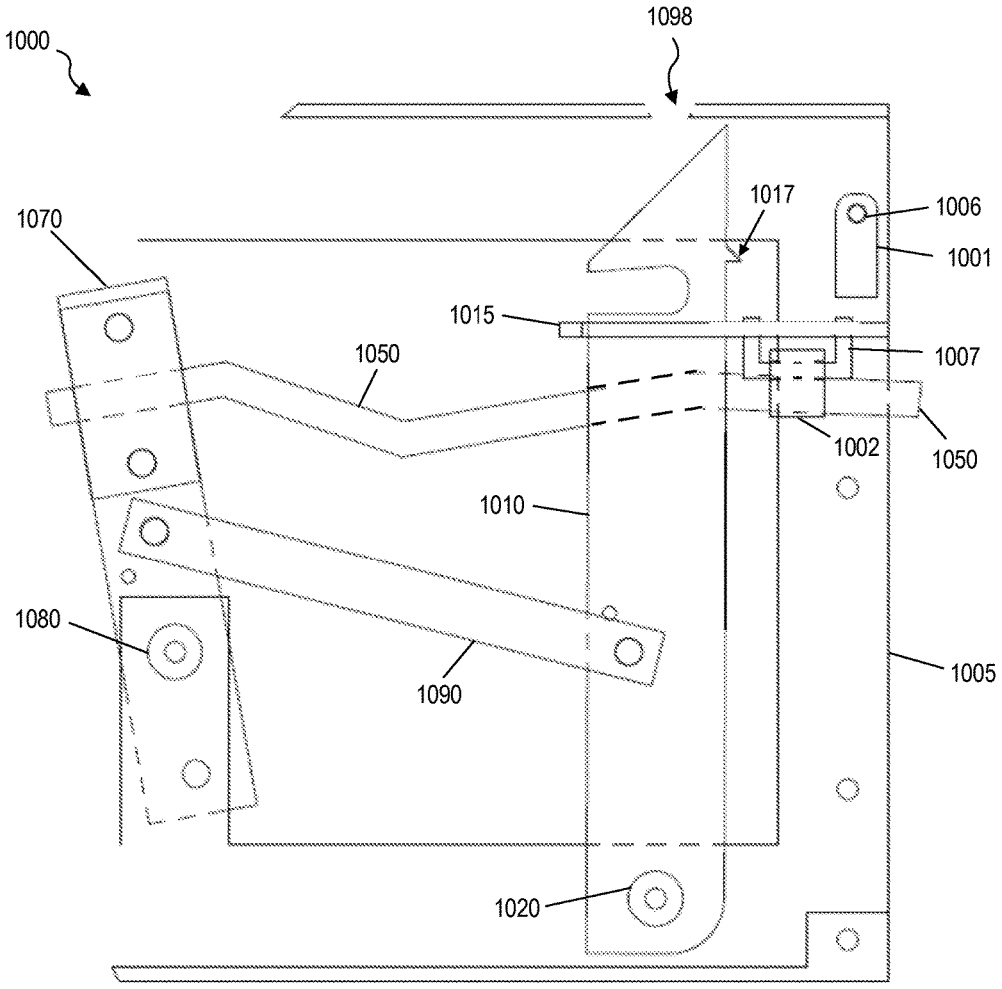
FIG. 10 shows one embodiment of a mechanism for securing a lid of a container to prevent animal intrusion with a notched arm in a lid-securing orientation.

FIG. 10 shows a mechanism 1000 for securing a lid of a container to prevent animal intrusion with a notched arm 1010 in a lid-securing orientation. For clarity of illustration, dashed lines indicate portions of components located behind another component and therefore hidden from view from the perspective of FIG. 10. Notched arm 1010, which is an example of notched arm 500 of FIG. 5, rotates about a pivot 1020. For clarity of illustration, FIG. 10 does not show a lid, hinge, catch, or spring as in FIGS. 6, 8, and 9, but mechanism 1000 may be used with a lid, hinge, catch, or spring for the purpose of securing a lid of a container in the closed position. The embodiment of mechanism 1000 depicted in FIG. 10 does not include a lower portion of notched arm 1010, nor a second release lever mechanically connected thereto, as with mechanism 600 shown in FIG. 6, but mechanism 1000 may be modified as such without departing from the scope hereof.

FIG. 10 shows a release lever 1050, which is an embodiment of first release lever 150 of FIG. 1. In the embodiment shown in FIG. 10, release lever 1050 is not attached to notched arm 1010, but is instead mechanically coupled to a stay 1070, which is an embodiment of stay 670 of FIG. 6. Stay 1070 rotates about a pivot 1080. A brace 1090 mechanically couples to both stay 1070 and notched arm 1010. Motion imparted to release lever 1050 causes stay 1070 to rotate about pivot 1080, thereby displacing brace 1090, which rotates notched arm 1010 about pivot 1020 into the lid-freeing orientation (see, for example, FIG. 11). The lid-freeing orientation of notched arm 1010 permits freeing a container lid for example. In an embodiment, notched arm 1010 moves in a plane of motion that is constrained by a guide 1015. Guide 1015 serves to limit motion of notched arm 1010 to within a desired range, namely from the lid-securing orientation to the lid-freeing orientation.

FIG. 10 also shows a first swivel lock 1001 attached to a frame 1005 via a first bar 1006. First swivel lock 1001 swings freely in a first plane of motion, orthogonal to first bar 1006, to remain in a consistent orientation with respect to gravity when mechanism 1000 is tilted in the first plane of motion. Frame 1005 is mounted to a container, such as container 305 of FIG. 3, using rivets 1097 to mechanically support mechanism 1000. Frame 1005 includes a gap 1098 to provide a path for movement of a catch, such as catch 640 of FIG. 6, while the lid is being opened or closed. Upon tilting mechanism 1000 in a first direction, first swivel lock 1001 swings toward notched arm 1010 thereby blocking notched arm 1010 from pivoting to remain in the lid-securing orientation.

A second swivel lock 1002 swings freely behind release lever 1050 in a second plane of motion about a second bar 1007, which is rigidly attached to guide 1015. Second swivel lock 1002 remains in a consistent orientation with respect to gravity when mechanism 1000 is tilted in the second plane of motion. Upon tilting a container in a second direction, orthogonal to the first direction, the second swivel lock 1002 swings to block notched arm 1010 from pivoting to remain in the lid-securing orientation.

Notched arm 1010 includes a protrusion 1017, which is an example of protrusion 517 of FIG. 5. Protrusion 1017 is configured to contact first swivel lock 1001 when notched arm 1010 pivots away from the lid-securing orientation and the container is tilted in a first direction (see for example FIG. 11).

Figure 11:
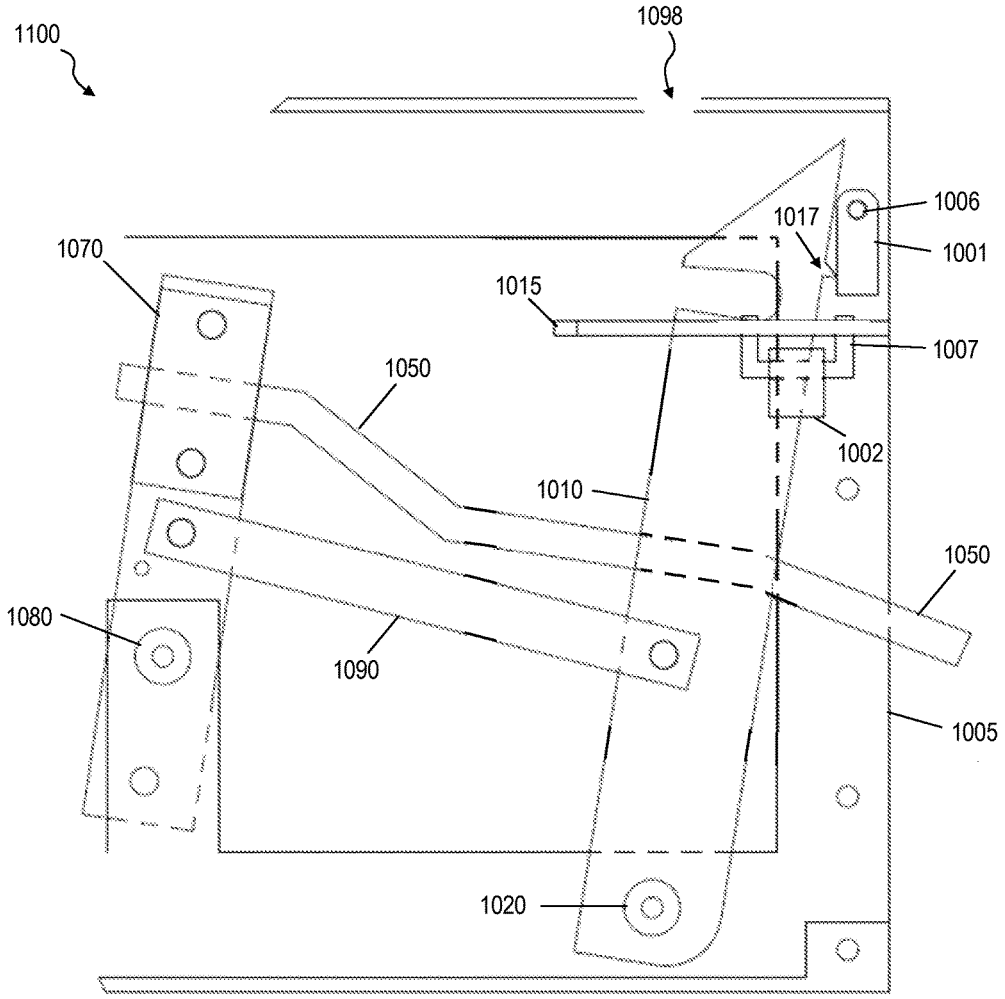
FIG. 11 shows the mechanism of FIG. 10 with release lever pressed down to rotate the notched arm away from the lid-securing orientation.

FIG. 11 shows mechanism 1100, which is an example of mechanism 1000 of FIG. 10, with release lever 1050 pressed downward to rotate notched arm 1010 away from the lid-securing orientation. For clarity of illustration, dashed lines indicate portions of components located behind another component and therefore hidden from view from the perspective of FIG. 11. With respect to FIG. 10, stay 1070 is rotated about pivot 1080, brace 1090 is displaced, and notched arm 1010 is rotated. Note that protrusion 1017 is shown in contact with first swivel lock 1001 in FIG. 11.

Mechanisms 1000 and 1100 of FIGS. 10 and 11, respectively, may include a guard, such as guard 286 of FIG. 2 that protects notched arm 1010 and all associated lid-locking components. Guard 286 provides protection from obstruction or damage due to contact with container contents, if located inside the container. If located outside the container, guard 286 provides protection from external hazards including animals.

Figure 12:
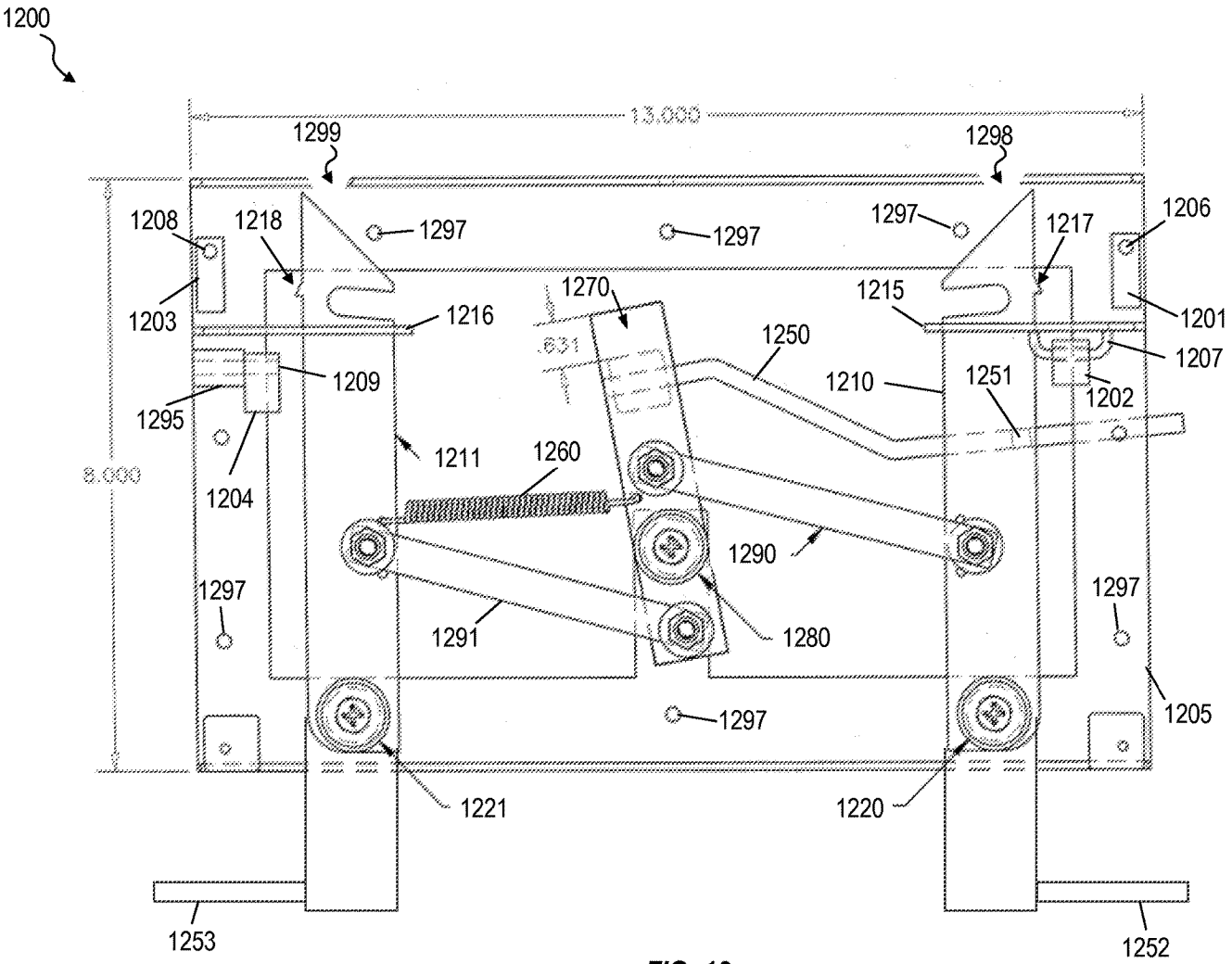
FIG. 12 shows one embodiment of a mechanism for securing a lid of a container to prevent animal intrusion with two notched arms.

FIG. 12 shows a mechanism 1200 for securing a lid of a container to prevent animal intrusion. Mechanism 1200 has two notched arms for securing a lid of a container, specifically a first notched arm 1210 and a second notched arm 1211. For clarity of illustration, FIG. 12 does not show a lid, hinge or catch, as in FIGS. 6, 8, and 9, but mechanism 1200 may be used with a lid, hinge, or catch, for the purpose of securing a lid of a container in the closed position. For further clarity of illustration, dashed lines are used to show portions of components located behind other components, from the perspective of FIG. 12, and therefore hidden from view. FIG. 12 includes exemplary dimensions for system 1200 in inches, including an overall height of 8.0 inches and an overall width of 13.0 inches, according to one embodiment.

First notched arm 1210 is mechanically connected to a frame 1205 with a first pivot 1220, and second notched arm 1211 is mechanically connected to frame 1205 with a second pivot 1221. Frame 1205, which is an example of frame 1005 of FIG. 10, is mounted to a container with rivets 1297, for example. First notched arm 1210 and second notched arm 1211 move in a plane of motion within a range that is constrained by a first guide 1215 and a second guide 1216, respectively. A first release lever 1250 is rigidly attached to a stay 1270, which is an embodiment of stay 1070 of FIG. 10. Dashed lines illustrate portions of first release lever 1250 located behind another component from the perspective of FIG. 12. For example, attachment of first release lever 1250 is illustrated behind stay 1270 with dashed lines. Similarly, a portion of first release lever 1250 is located behind first notched arm 1210, as illustrated with dashed lines in FIG. 12. First release lever 1250 includes a bend 1251 configured to bend a portion of first release lever 1250 for passing behind frame 1205, which is also illustrated with dashed lines in FIG. 12.

Figure 13:
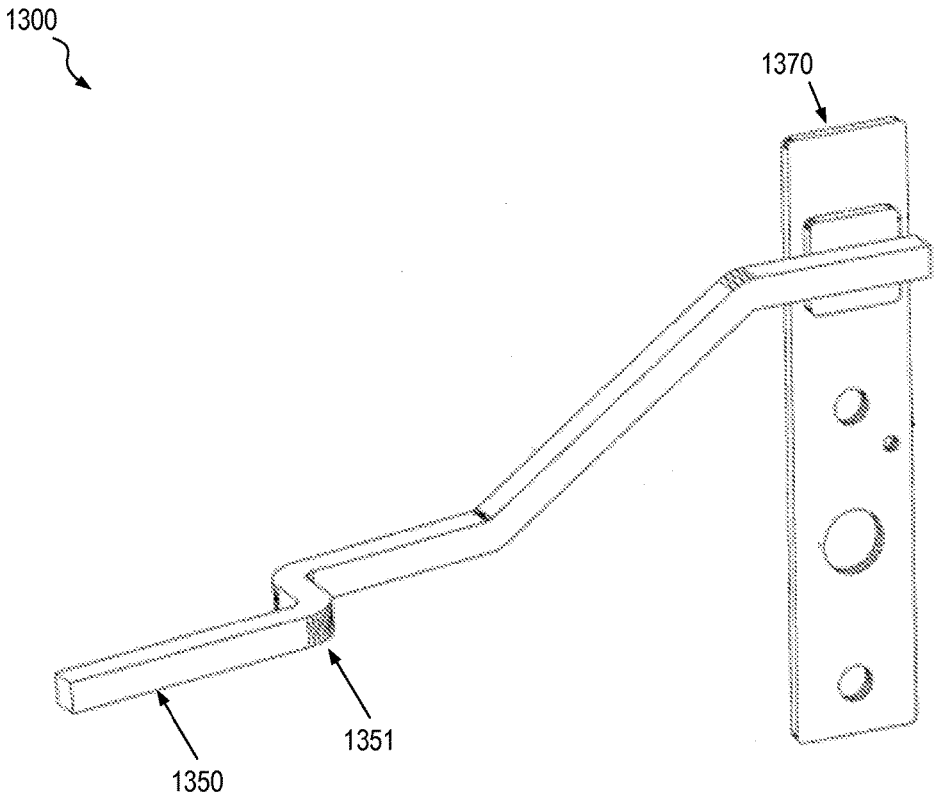
FIG. 13 shows a perspective view of a release lever of FIG. 12, in an embodiment.

FIG. 13 shows a perspective view 1300 of a release lever 1350, which is an example of first release lever 1250 of FIG. 12. Release lever 1350 is mechanically coupled to stay 1370, which is an example of stay 1270 of FIG. 12. A bend 1351 provides proper alignment of release lever 1350 for protruding outside a container, such as container 105 of FIG. 1.

Figure 14:
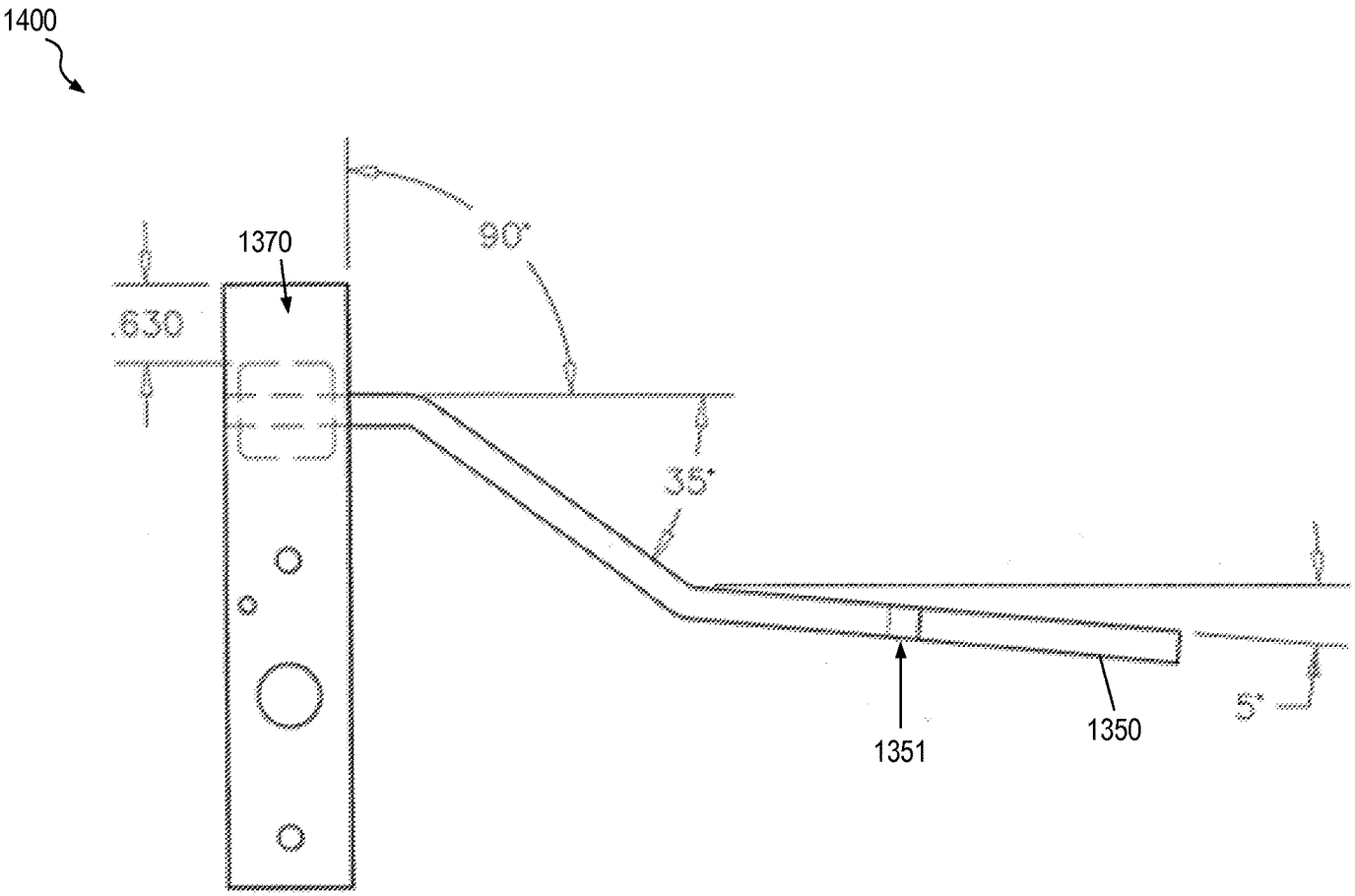
FIG. 14 shows the release lever of FIG. 13 in exemplary detail.

FIG. 14 shows a side view 1400 of the release lever of FIG. 13 that includes dimensions in inches and angles in degrees. For example, a first portion of release lever 1350 forms a ninety degree angle from stay 1370, a second portion bends downward at a thirty-five degree angle from the first portion, and a third portion bends downward at a five degree angle below the first portion.

Referring again to FIG. 12, stay 1270 rotates about a third pivot 1280. A first brace 1290 mechanically couples to a first side of stay 1270 and to first notched arm 1210, and a second brace 1291 mechanically couples to a first side of stay 1270 and to second notched arm 1211. Motion imparted to the first release lever 1250 causes stay 1270 to rotate about third pivot 1280, thereby displacing both first and second braces 1290, 1291. The brace displacements rotate first notched arm 1210 and second notched arm 1211 about first pivot 1220 and second pivot 1221, respectively. Downward motion imparted to first release lever 1250 rotates first and second notched arms 1210, 1211 into the lid-freeing orientation, permitting a container lid, such as lid 330 of container 305, to be opened.

FIG. 12 includes a second release lever 1252 and a third release lever 1253 mechanically coupled to first notched arm 1210 and second notched arm 1211, respectively. Second and third release levers 1252, 1253 are examples of second release lever 652 shown in FIGS. 6, 8, and 9. Second release lever 1252 is configured to be pressed inward to rotate first notched arm 1210 about pivot 1220. Similarly, third release lever 1253 is configured to be pressed inward to rotate second notched arm 1211 about pivot 1221. Pressing either second release lever 1252 or third release lever 1253 inward rotates both first and second notched arms 1210, 1211 into the lid-freeing orientation due to mechanical coupling provided by first and second braces 1290, 1291 and stay 1270. Second and third release levers 1252, 1253 are configured to be pressed by a mechanical claw, such as mechanical claw 290 of FIG. 2 or mechanical claw 1500 of FIGS. 15 and 16.

Frame 1205 includes a first gap 1298 and a second gap 1299. The gaps 1298, 1299 provide a path for movement of catches, such as first and second catch 440, 442 of FIG. 4, while the lid is being opened or closed. FIG. 12 shows a spring 1260 mechanically coupled to stay 1270 and second notched arm 1211. In an embodiment, spring 1260 is an extension spring with two to three pounds of force. Spring 1260 acts to return first and second notched arms 1210, 1211 from the lid-freeing orientation to the lid-securing orientation upon release of first, second and third release levers 1250, 1251, 1252. Spring 1260 acts directly on second notched arm 1211 and indirectly on first notched arm 1210 via first brace 1290. Mechanism 1200 may be protected by a guard, similar to guard 286 of FIG. 2, while mounted to an interior or exterior surface of a container, such as container 305 of FIG. 3.

Mechanism 1200 further includes swivel locks that swing freely to remain in a consistent orientation with respect to gravity when mechanism 1200 is tilted. Swivel locks swing freely about bars, for example. Specifically, a first swivel lock 1201 swings freely about a first bar 1206, and a second swivel lock 1202 swings freely about a second bar 1207, which are examples of first swivel lock 1001 and first bar 1006, and second swivel lock 1002 and second bar 1007 of FIG. 10, respectively. Mechanism 1200 further includes a third swivel lock 1203 that swings freely about a third bar 1208 and a fourth swivel lock 1204 that swings freely about a fourth bar 1209. Third bar 1208 attaches directly to frame 1205. First bar 1206 and third bar 1208 are viewed from a cross-sectional perspective in FIG. 12. Fourth bar 1209 attaches to a bracket 1295, wherein bracket 1295 is attached to frame 1205. Second bar 1207 and fourth bar 1209 include portions that pass through second swivel lock 1202 and fourth swivel lock 1204, respectively, as illustrated with dashed lines in FIG. 12.

Upon tilting mechanism 1200 in a first direction, first swivel lock 1201 swings toward first notched arm 1210, thereby blocking first notched arm 1210 from pivoting to remain in the lid-securing orientation. Similarly, upon tilting mechanism 1200 in a second direction, orthogonal to the first direction, second swivel lock 1202 swings behind first notched arm 1210, thereby blocking first notched arm 1210 from pivoting to remain in the lid-securing orientation. Likewise, third swivel lock 1203 swings toward second notched arm 1211 when mechanism 1200 is tilted in a third direction, opposite the first direction, thereby blocking second notched arm 1211 from pivoting to remain in the lid-securing orientation. Finally, fourth swivel lock 1204 swings behind second notched arm 1211 when mechanism 1200 is tilted in a fourth direction, opposite the second direction, thereby blocking second notched arm 1211 from pivoting to remain in the lid-securing orientation. Because first and second notched arms 1210, 1211 are mechanically coupled via first and second braces 1290, 1291 and stay 1270, when either notched arm is secured by a swivel lock, both notched arms 1210, 1211 are prevented from unlocking, thereby preventing unwanted opening of the lid when the container deviates, in any direction, from a preferred (upright) orientation.

First notched arm 1210 includes a protrusion 1217 that serves as a lock stop for first swivel lock 1201. Similarly, second notched arm 1211 includes a protrusion 1218 that serves as a lock stop for third swivel lock 1203.

FIG. 15 depicts a mechanical claw 1500 for automatically releasing a lid of a container while grasping the container. Mechanical claw 1500 is an example of mechanical claw 290 of FIG. 2. FIG. 16 depicts mechanical claw 1500 of FIG. 15 from a side perspective. FIGS. 15 and 16 are best viewed together with the following description. Mechanical claw 1500 includes a first arm 1501 and a second arm 1502 for simultaneously grasping a container, such as container 305 of FIG. 3 or a container 1705 of FIG. 17, for example. Additional container embodiments described herein may also be used with mechanical claw 1500 without departing from the scope hereof. First and second arms 1501, 1502 are made of steel and mechanically coupled to a garbage truck at a first attachment 1511 and a second attachment 1512, respectively. First and second attachments 1511, 1512 are hydraulically powered and move laterally to bring first and second arms 1501, 1502 alternatively together and apart, thereby grasping and releasing container 305.

First and second arms 1501, 1502 include a first strap 1521 and a second strap 1522, respectively, made of nylon for example. First and second straps 1521, 1522 are configured to physically contact container 305 for grasping to lift and tilt container 305 for emptying. While grasping container 305, first and second straps 1521, 1522 press second release lever 352 and third release lever 353 simultaneously to release the locking mechanism thereby releasing lid 330 of container 305. Thus, container 305 with lid 330 and release levers 352, 353 form a system, together with mechanical claw 1500, for preventing animal intrusion that enables automatic opening of container 305 for emptying contents into a garbage truck. An advantage over prior art systems is that the garbage truck driver is not required to exit the truck to release lid 330 of container 305 prior to emptying container 305 contents.

Referring again to FIGS. 15 and 16, first and second straps 1521, 1522 are mechanically coupled to their respective arm with a stationary end and a spring-constrained end. For example, first strap 1521 is coupled to first arm 1501 by a first stationary end 1531 and a first spring-constrained end 1541. First stationary end 1531 is held stationary to first arm 1501 by bolts, for example. First spring-constrained end 1541 is mechanically coupled to a first spring 1551 by a first fork 1561. First fork 1561 is for example bolted to first strap 1521 and passes through a first bracket 1571 for securing first spring 1551. First strap 1521, first fork 1561, and first spring 1551 are configured to enable first spring-constrained end 1541 to move against the force of first spring 1551 when container 305 is grasped with first strap 1521. A first post 1581 and a second post 1582 are attached to first arm 1501 by weld, for example, to guide first strap 1521 to a desired orientation for grasping container 305. First strap 1521 slides about second post 1582 as first spring-constrained end 1541 moves. A maximum pressure of first strap 1521 on container 305 is limited by the force of first spring 1551, thereby preventing first arm 1501 from crushing container 305. First spring 1561 may be a linear spring configured as a compression spring, as is depicted in FIGS. 15 and 16. However, the drawings are not intended to limit the scope of the spring, but merely to illustrate one potential type of spring. Other types of appropriate springs include leaf springs, extension springs, and torsional springs.

Likewise, second strap 1522 is coupled to second arm 1502 by a second stationary end 1532 and a second spring-constrained end 1542. Second stationary end 1532 is held stationary to second arm 1502 by bolts, for example. Second spring-constrained end 1542 is mechanically coupled to a second spring 1552 by a second fork 1562. Second fork 1562 is for example bolted to second strap 1522 and passes through a second bracket 1572 for securing second spring 1552. Second strap 1522, second fork 1562, and second spring 1552 are configured to enable second spring-constrained end 1542 to move against the force of second spring 1552 when container 305 is grasped with second strap 1522. A third post 1583 and a fourth post 1584 are attached to second arm 1502 by weld, for example, to guide second strap 1522 to a desired orientation for grasping container 305. Second strap 1522 slides about fourth post 1584 as second spring-constrained end 1542 moves. A maximum pressure of second strap 1522 on container 305 is limited by the force of second spring 1552, thereby preventing second arm 1502 from crushing container 305.

First and second arms 1501, 1502 further include one or more rubber bumpers 1591, 1592, respectively, to prevent steel of the arms from contacting container 305, thereby reducing potential for damage to container 305.

FIG. 16 shows a portion of first strap 1521 backed with a first leather piece 1595 to prevent metal portions of first arm 1501 from damaging nylon material of first strap 1521 due to abrasion. First leather piece 1595 is fixed to first strap 1521 using bolts or rivets for example. Second strap 1522 is similarly backed with a second leather piece 1596.

Figure 17:
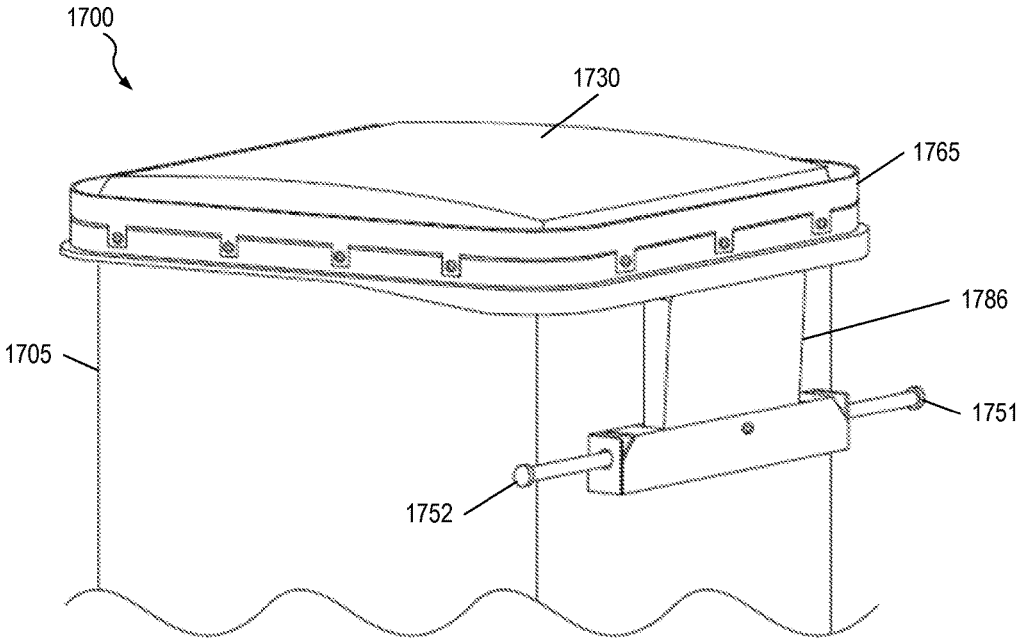
FIG. 17 depicts one embodiment of a system for securing a lid of a container to prevent animal intrusion.
Figure 18:
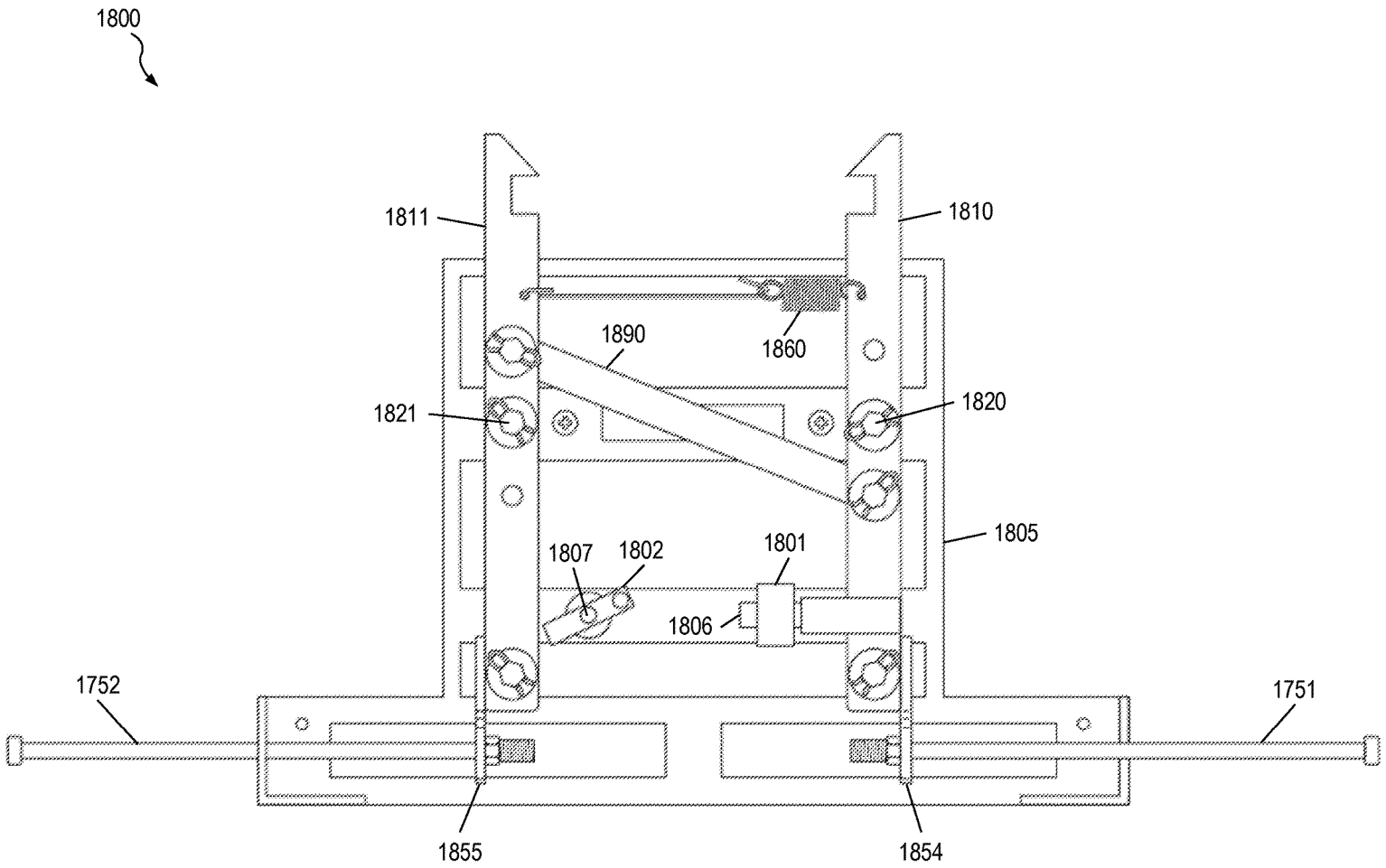
FIG. 18 depicts one embodiment of a mechanism for securing a lid of a container to prevent animal intrusion.

FIG. 17 shows a system 1700 for securing a lid of a container to prevent animal intrusion, which is similar to system 300 of FIG. 3. System 1700 includes a container 1705, a lid 1730, and a flange 1765 for protecting lid 1730. Container 1705, lid 1730, and flange 1765 are similar to container 305, lid 330, and flange 365 of FIG. 3, respectively. System 1700 further includes a mechanism, such as a mechanism 1800 of FIG. 18 for example, which may be protected by a guard 1786, similar to guard 286 of FIG. 2, and mounted on an external surface of container 1705. FIGS. 17 and 18 are best viewed together with the following description.

System 1700 includes a first release lever 1751 and a second release lever 1752, which are similar to second release lever 352 and third release lever 353 of FIG. 3 and are used to release the lid from being secured in a closed position. First and second release levers 1751, 1752 may be pressed simultaneously by mechanical means, such as mechanical claw 1500 of FIGS. 15 and 16.

Mechanical claw 1500 may grasp container 1705 such that first and second straps 1521, 1522 press first release lever 1751 and second release lever 1752 simultaneously to release the locking mechanism thereby releasing lid 1730. Thus, container 1705 with lid 1730 and release levers 1751, 1752 form a system, together with mechanical claw 1500, for preventing animal intrusion that enables automatic opening of container 1705 for emptying contents into a garbage truck.

FIG. 18 shows mechanism 1800 for securing a lid of a container to prevent animal intrusion. Mechanism 1800 is similar to mechanism 1200 of FIG. 12 and may be configured to secure lid 1730 to container 1705 (of FIG. 17). Mechanism 1800 includes a first notched arm 1810 and a second notched arm 1811. First notched arm 1810 is mechanically connected to a frame 1805 with a first pivot 1820, and second notched arm 1811 is mechanically connected to frame 1805 with a second pivot 1821. Frame 1805, which is an example of frame 1205 of FIG. 12, mounts to an interior or exterior container wall for supporting mechanism 1800 in position to secure the container lid.

A first release lever 1751 is mechanically coupled to first notched arm 1810 via a first bracket 1854, for example. Similarly, a second release lever 1752 is mechanically coupled to second notched arm 1811 via a second bracket 1855, for example. First and second brackets 1854, 1855 are examples of bracket 654 of FIG. 6. First and second release levers 1751, 1752 each include a free end that protrudes outside guard 1786 for pressing, as shown in FIG. 17. Pressure applied to the free end of each release lever causes a respective notched arm to rotate. For example, pressure applied to the free end of first release lever 1751 rotates first notched arm 1810 about first pivot 1820. Similarly, pressure applied to the free end of second release lever 1752 rotates second notched arm 1811 about second pivot 1821. A brace 1890 mechanically couples first notched arm 1810 to second notched arm 1811. Brace 1890 is configured such that motion imparted to either release lever 1751, 1752, causes both notched arms 1810, 1811 to rotate into the lid-freeing orientation, permitting a container lid to be opened. When freeing a lid by hand (such as lid 1730 of FIG. 17, for example), a user presses either first or second release lever 1751, 1752 with one hand and simultaneously lifts lid 1730 with the other hand, making it unlikely for an animal to perform. A spring 1860 mechanically couples first notched arm 1810 and second notched arm 1811. Spring 1860 is for example a spring that acts to return first and second notched arms 1810, 1811 from the lid-freeing orientation to the lid-securing orientation upon release of first and second release levers 1751, 1752.

FIG. 18 depicts a first swivel lock 1801 that swings freely about a first bar 1806, and a second swivel lock 1802 that swings freely about a second bar 1807, which are examples of first swivel lock 1201 and first bar 1206, and second swivel lock 1202 and second bar 1207 of FIG. 12, respectively. First swivel lock 1801 swings due to gravity when mechanism 1800 is tilted back or forth in a first plane of motion, thus blocking first notched arm 1810 from being rotated to a lid-freeing orientation. Second swivel lock 1802 swings due to gravity when mechanism 1800 is tilted back or forth in a second plane of motion, orthogonal to the first plane of motion, thus blocking notched arm 1811 from pivoting to a lid-freeing orientation. First and second swivel locks 1801, 1802 maintain first and second notched arms 1810, 1811 in a secured orientation when mechanism 1800 is tilted in any direction from a preferred (upright) orientation.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A system for securing a lid of a container to prevent animal intrusion, comprising:

a first notched arm including a first notch, the first notched arm coupled to the container about a first pivot;

a first catch coupled to the lid at a location corresponding to the first notched arm and configured to hook the notch to maintain the lid in a closed position;

a first release lever coupled to the first notched arm and protruding outside the container for releasing the first notched arm from the first catch such that the lid may move to an opened position;

a second notched arm including a second notch and an angled end, the second notched arm coupled to the container about a second pivot;

a second catch fixed to the lid at a second location corresponding to the second notched arm and configured to hook the second notch to maintain the lid in the closed position; and at least one gravity-actuated swivel lock for blocking either the first or second notched arm from pivoting to maintain the lid in its closed position when the container is tilted in any direction from a preferred orientation;

wherein the at least one gravity-actuated swivel lock comprises:

a first swivel lock that swings to maintain consistent orientation with respect to gravity when the container is tilted in a first direction, the first swivel lock blocking the first notched arm from pivoting when the container is tilted in the first direction; and a second swivel lock that swings to maintain consistent orientation with respect to gravity when the container is tilted in a second direction, the second swivel lock blocking the first notched arm from pivoting when the container is tilted in the second direction, the second direction being orthogonal to the first direction, wherein the second notched arm is mechanically coupled to the first release lever for releasing the second notched arm from the second catch such that the lid may move to the opened position.

2. The system of claim 1, the first notched arm comprising an angled end aligned with the first catch to cause pivoting of first notched arm about the first pivot when contacted by the first catch.

3. The system of claim 1, further comprising a spring mechanically coupled to the first notched arm to counter rotate the first notched arm about the first pivot, thereby automatically hooking the first catch to secure the lid in the closed position.

4. The system of claim 1, further comprising a second release lever coupled to the first notched arm that protrudes outside the container for releasing the first notched arm from the first catch for opening the lid independently from the first release lever.

5. The system of claim 1, further comprising a gravity-actuated swivel lock for locking the first notched arm to prevent the lid from opening when the container is tilted.

6. The system of claim 1, further comprising a frame coupled between the first notched arm and the container.

7. The system of claim 1, further comprising a first guide surrounding the first notched arm to restrict the range of motion of the first notched arm.

8. The system of claim 1, the first and second notched arm being mechanically coupled to the first release lever via a stay located between the first and second notched arm, and wherein the first release lever is coupled to the stay.

9. The system of claim 8, the stay coupled to the container about a third pivot; the first notched arm coupled to the stay via a first brace attached to the stay on a first side of the third pivot; the second notched arm coupled to the stay via a second brace attached to the stay on a second side of the third pivot.

10. The system of claim 9, further comprising a spring mechanically coupled between the stay and the second notched arm to counter rotate the first and second notched arms respectively about the first and second pivots, thereby automatically hooking the first and second catch to secure the lid in the closed position.

11. The system of claim 1, further comprising a second guide surrounding the second notched arm to restrict the range of motion of the second notched arm.

12. A system for securing a lid of a container to prevent animal intrusion, comprising:

a first notched arm including a first notch, the first notched arm coupled to the container about a first pivot;

a first catch coupled to the lid at a location corresponding to the first notched arm and configured to hook the notch to maintain the lid in a closed position;

a first release lever coupled to the first notched arm and protruding outside the container for releasing the first notched arm from the first catch such that the lid may move to an opened position;

a second notched arm including a second notch and an angled end, the second notched arm coupled to the container about a second pivot;

a second catch fixed to the lid at a second location corresponding to the second notched arm and configured to hook the second notch to maintain the lid in the closed position; and at least one gravity-actuated swivel lock for blocking either the first or second notched arm from pivoting to maintain the lid in its closed position when the container is tilted in any direction from a preferred orientation;

wherein the second notched arm is mechanically coupled to the first release lever for releasing the second notched arm from the second catch such that the lid may move to the opened position.

13. The system of claim 1, the at least one gravity-actuated swivel lock further comprising:

a third swivel lock that swings to maintain consistent orientation with respect to gravity when the container is tilted in a third direction, the third direction being opposite the first direction, the third swivel lock blocking the second notched arm from pivoting when the container is tilted in the third direction; and a fourth swivel lock that swings to maintain consistent orientation with respect to gravity when the container is tipped in a fourth direction, the fourth direction being opposite the third direction, the fourth swivel lock blocking the second notched arm from pivoting when the container is tilted in the fourth direction.

14. A system for securing a lid of a container to prevent animal intrusion, comprising:

a first notched arm and a second notched arm, each mechanically coupled to the container about a first pivot and a second pivot, respectively;

a first catch and a second catch, each fixed to the lid at a location corresponding to the first and second notched arms, respectively, and configured to hook the notch of the respective notched arm, thereby securing the lid in the closed position;

a first release lever and a second release lever, each mechanically coupled to first notched arm and second notched arm, respectively, wherein first and second release levers protrude outside the container and are configured to release the lid when pressed;

a first gravity-actuated swivel lock for locking the first notched arm to prevent the lid from unwanted opening when the container is tilted in a first direction or a second direction, opposite the first direction; and a second gravity-actuated swivel lock for locking the second notched arm to prevent the lid from unwanted opening when the container is tilted in a third direction, orthogonal to the first direction, or a fourth direction, opposite the third direction.

15. The system of claim 14, the first and second notched arms each having an angled end aligned with the respective first and second catch to cause rotation of each respective notched arm about its pivot when contacted by the respective catch.

16. The system of claim 14, the first and second notched arms comprising a brace that mechanically couples the first notched arm to the second notched arm, thereby causing both the first and the second notched arms to rotate when either the first release lever or the second release lever is pressed.

17. The system of claim 14, further comprising a spring mechanically coupled between the first and second notched arms to maintain the lid secured closed when the first and second release levers are not pressed.

18. The system of claim 1, wherein the first notched arm includes a protrusion that serves as a lock stop for the first swivel lock.

19. The system of claim 1, further comprises a guard to protect the first notched arm from obstruction or damage.

20. The system of claim 14, wherein the first release lever and the second release lever are configured to be simultaneously pressed by a mechanical means.

21. The system of claim 14, wherein the system further comprises a third release lever that pivots the second notched arm.

* * * * *